US007882868B2

(12) United States Patent
Lessard

(10) Patent No.: US 7,882,868 B2
(45) Date of Patent: Feb. 8, 2011

(54) COMPACT AND PORTABLE WOOD SPLITTER

(76) Inventor: Martin Lessard, 223, rue Principale, Lamarche, Quebec (CA) G0W 1X0

( * ) Notice: Subject to any disclaimer, the term of this patent is extended or adjusted under 35 U.S.C. 154(b) by 541 days.

(21) Appl. No.: 11/601,647

(22) Filed: Nov. 20, 2006

(65) Prior Publication Data

US 2007/0107805 A1 May 17, 2007

(30) Foreign Application Priority Data

Nov. 14, 2005 (CA) ..... 2525495

(51) Int. Cl.
*B27L 7/00* (2006.01)

(52) U.S. Cl. ..... 144/193.1; 144/195.1; 144/366; 83/675

(58) Field of Classification Search ..... 144/4.6, 144/34.6, 24.12, 192, 193.1, 195.4, 195.5, 144/195.8, 195.6, 193.2, 194, 195.7, 195.1; 81/463, 465, 466; 30/108, 104, 406, 93, 30/153, 166.3, 244, 245, 228, 231; 83/675, 83/601, 607, 626, 870–874
See application file for complete search history.

(56) References Cited

U.S. PATENT DOCUMENTS 2,526,362 A * 10/1950 Johnston ..... 225/96
3,274,872 A * 9/1966 Kirsten ..... 83/162
3,779,295 A * 12/1973 Balsbaugh ..... 144/195.1
3,946,776 A * 3/1976 Oldenburg et al. ..... 144/34.5
4,086,111 A * 4/1978 Corey ..... 144/195.1
4,198,747 A * 4/1980 LaBounty ..... 30/134
4,364,292 A * 12/1982 Wozniak et al. ..... 83/605
4,380,258 A * 4/1983 Hanser ..... 144/195.1
4,452,286 A * 6/1984 Menzi ..... 144/34.1
4,487,239 A * 12/1984 Anderson ..... 144/195.1
4,501,309 A * 2/1985 Sinden ..... 144/195.1
4,615,367 A * 10/1986 Crowley, Jr. ..... 144/366
4,660,451 A * 4/1987 Bjorkheim ..... 83/527
4,896,574 A * 1/1990 Hull et al. ..... 83/675
4,905,746 A * 3/1990 Bedard ..... 144/195.7
4,908,946 A * 3/1990 Labounty ..... 30/134
4,945,960 A * 8/1990 McCauley ..... 144/195.1
5,142,779 A * 9/1992 LaBounty ..... 30/134
5,465,770 A * 11/1995 Lansberry ..... 144/336
5,724,876 A * 3/1998 Johnson ..... 83/602
5,953,975 A * 9/1999 Kreitzberg ..... 83/397
2004/0206859 A1* 10/2004 Chong et al. ..... 248/121
2004/0255737 A1* 12/2004 Sakato et al. ..... 83/13
2005/0132576 A1* 6/2005 Onion ..... 30/158

* cited by examiner

*Primary Examiner*—Dana Ross
*Assistant Examiner*—Jennifer Chiang

(57) ABSTRACT

The present invention concerns a compact, portable, light-weight, easily transportable, quickly operating wood splitting apparatus, using a knife which cuts a log or piece of wood that is deposed on a platform. This compact and portable wood splitter is actuated by a hydraulic cylinder transmitting a pendulum movement to a knife and onto an upright piece of wood. The apparatus may be attached to a truck box, to a trailer or to a wall by means of a vertical, horizontal, fixed or mobile fixture. The splitter apparatus is compact and portable and it can easily be stored in a car trunk or in a shed.

6 Claims, 5 Drawing Sheets

COMPACT AND PORTABLE WOOD SPLITTER

BACKGROUND OF THE INVENTION

This invention relates to the field of wood splitting using an apparatus which can be carried easily from one place to another.

PRIOR ART

Our research among patents revealed some systems that caught our attention:

U.S. Pat. No. 4,275,779, U.S. Pat. No. 5,526,855, U.S. Pat. No. 4,537,235, U.S. Pat. No. 4,700,759, U.S. Pat. No. 4,782,870, CA 1,084,814 These inventions describe methods of wood splitting using a cutting wedge for splitting wood logs.

U.S. Pat. No. 4,782,870, CA 1,084,814 and U.S. Pat. No. 5,526,855, U.S. Pat. No. 5,337,810 These bulky and heavy wood splitters have to be mounted on trailers moved by a car, a truck or a tractor.

U.S. Pat. No. 4,751,949 utilises a straight blade knife.

OBJECTIVES AND ADVANTAGES

PA general objective of this invention is the providing of an apparatus for splitting wood logs, particularly providing a portable wood splitter which can be easily carried and lifted up.

A specific objective of the invention is to provide an apparatus which can carry out wood splitting quickly. More specifically that the apparatus be light in weight and easily handled; it be easily stored due to its small volume (ex. It can be stored and carried in a car trunk). The splitting process is to be carried out by a pendulum positioned knife moved by an upwardly moving cylinder. The apparatus is used in an upright position while the log to be cut is also stand in an upright position before the splitting and cut in a longitudinal way to make pieces of firewood log for a domestic usage. Furthermore a person positions the firewood log and uses the foot pedal for initiating the cutting while protecting his or her back from aches in safe ergonomic position. The apparatus can adapt to variable log sizes.

BRIEF DESCRIPTION OF DRAWING FIGURES

DETAILED DESCRIPTION OF PREFERRED EMBODIMENTS

In the following description and in the accompanying drawings, the numeral numbers refers to identical parts in the various Figures.

Figure 1:
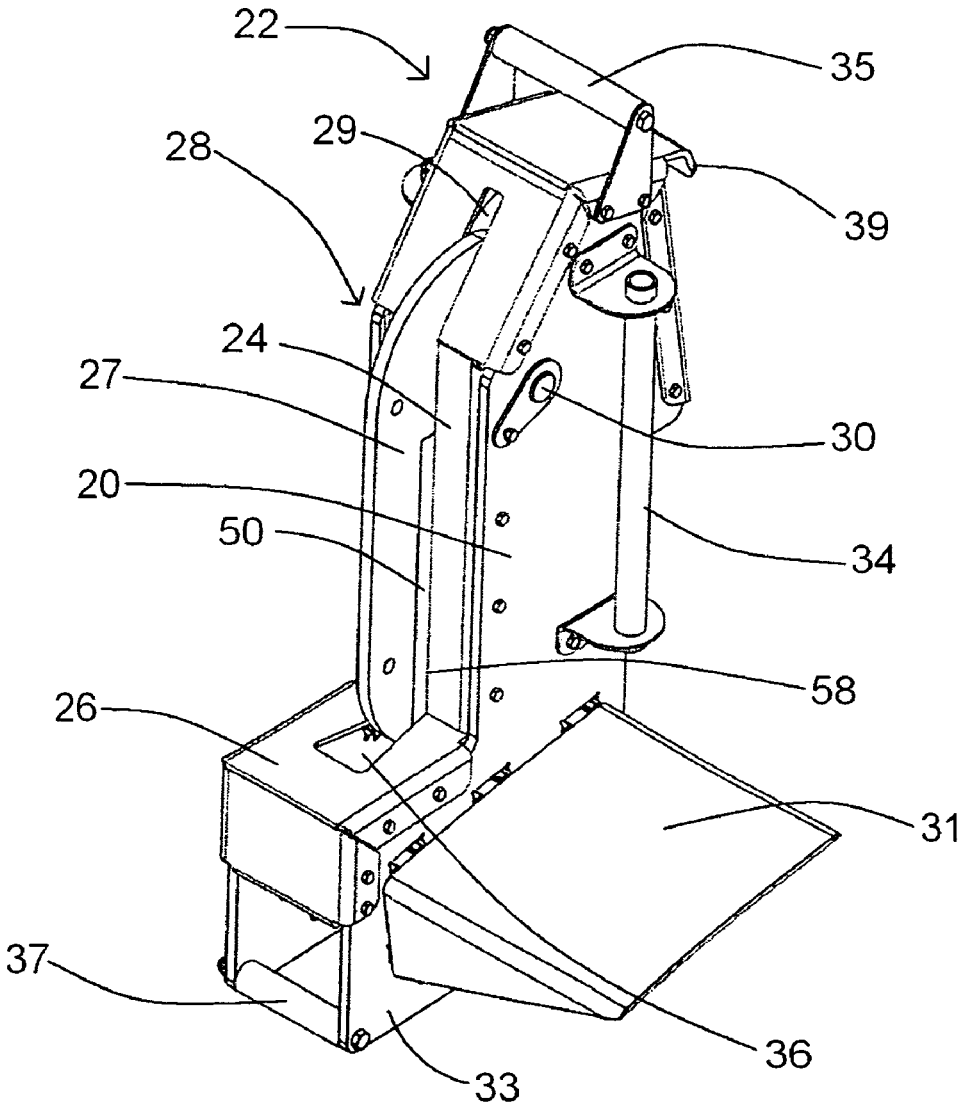
FIG. 1 is a perspective view of the wood splitter.

FIG. 1 shows the wood splitter 22 which possesses a protective enclosure 20. The protective enclosure 20 is supplied with lateral 34, top 35 and bottom 37 handles for helping in handling of the wood splitter 22. At the top of the enclosure 20, a dorsal hook 39 is used for installation of the apparatus on a wall at a user's convenience. At a base plate 33 of the enclosure, a lateral shelf 31 is positioned on one or the other side of the enclosure: it can easily be installed or de-installed. There is a front platform 26 for holding a piece of wood log. The platform is provided with a rectangular hole 36 for allowing wood debris and a blade 27 to pass through during and after a log cut. The enclosure is provided with a rigid front part 24 which is vertically sustaining a pivot attachment pin 30. The main element of the apparatus is a knife 28, of which the blade 27 is located as an external part with respect to the enclosure 20 and more particularly to the pivot pin 30, which acts as a rotation pivot for the knife 28. The knife 28 is inserted in a slit 50 located within the front face rigid part 24 of the enclosure 20. The slit 50 comprises an internal supporting plate 58 against which the blade 27 of the knife 28 is to rest after the cutting process is done so that the wood splitting is done safely. The knife 28 appears to proceed within an internal part 29 of the enclosure 20.

Figure 2:
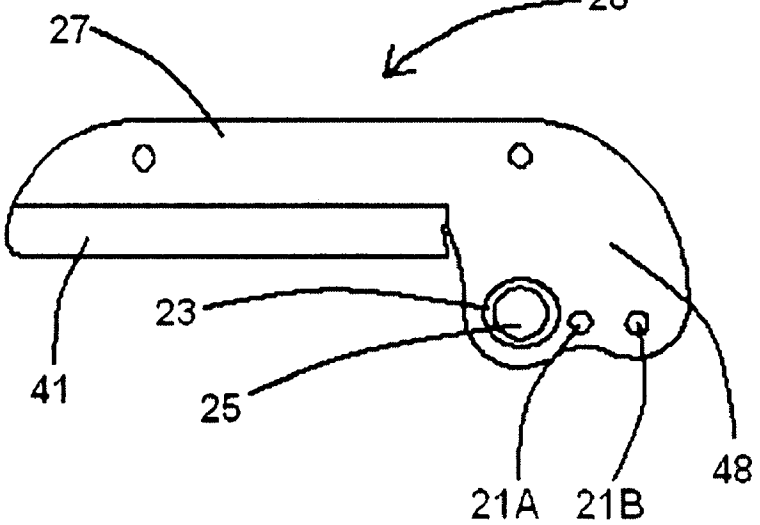
FIG. 2 is a side view of the knife.

FIG. 2 shows the knife 28 comprising an external part, the blade 27 and at its edge a cutting blade 41, and within the internal part 29, an arched in extension 48 which possesses an attachment hole 23 allowing the knife 28 to rotate around a rotation knife pivot hole 25. Two small attachment holes 21A and 21B in the lower area of the arched extension are used for attachment to a lever part.

Figure 3:
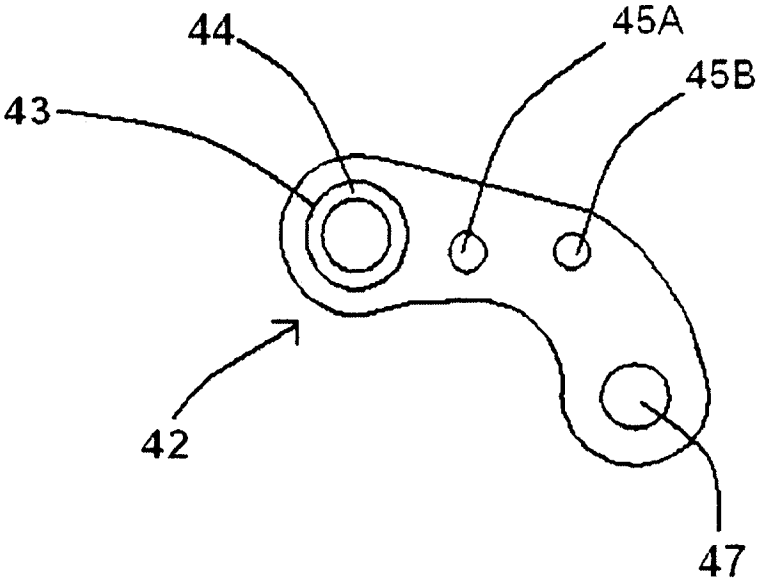
FIG. 3 is a side view of the pivot.

FIG. 3 shows a lever part 42 used for linking the knife 28 to the cylinder in such a way that a force be efficiently applied from a cylinder to the knife. On the lever part 42, there are four holes: the pivot hole 43 having the largest diameter corresponds to the pivoting axis of the pivot pin 30. The smaller diameter holes 45A and 4513 are linked to attachment points of the knife holes 21A and 21B using bolts. A bearing bushing 44 is placed at the edge of the pivot hole 43. A cylinder attachment hole 417 is used for attachment of the lever to the cylinder. The lever part is linked to the cylinder using a pivot pin inserted in the hole, so that a rotation movement around the hole 47 is performed.

Figure 4:
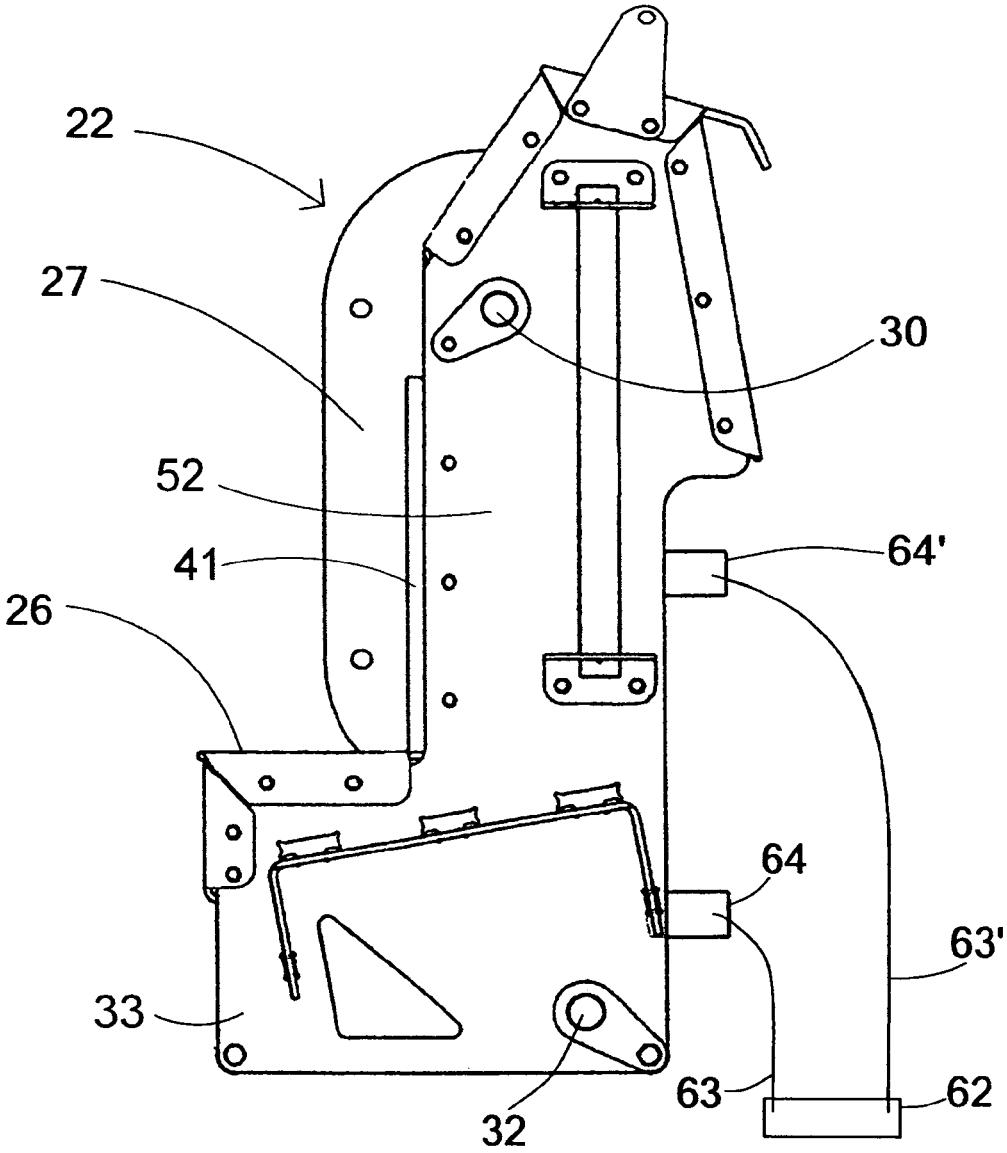
FIG. 4 is a side view of the wood splitter.

FIG. 4 shows a side view of the main external parts of the wood splitter 22: the blade 27 of the knife, the lower platform 26, the pivot axis pin 30, the support pin 32 for the cylinder and the two hydraulic connectors 64 for connecting pipes or hose for fluid 63 coming from an external hydraulic unit or through a foot pedal 62. One sees a lateral plate 52 forming a L with the base plate 33.

Figure 6:
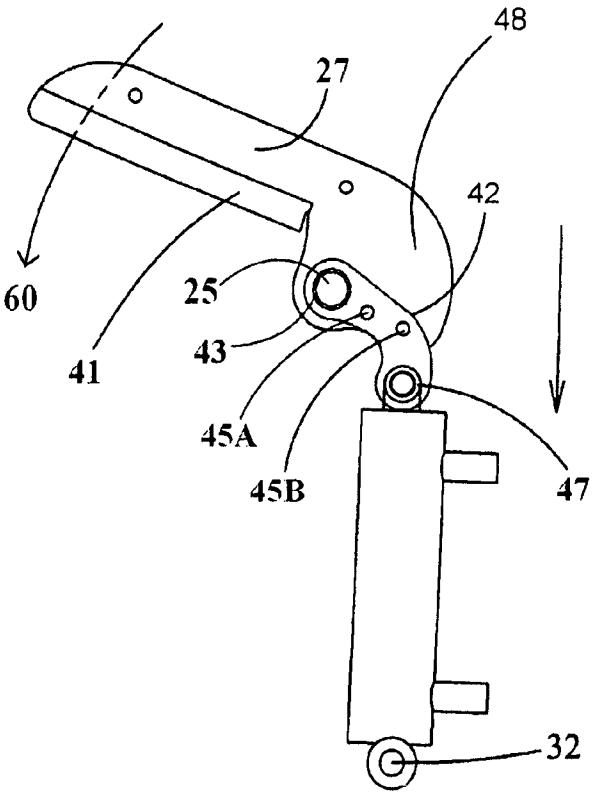
FIG. 6 is a side view of the internal elements of the wood splitter: knife with the contracted cylinder.
Figure 5:
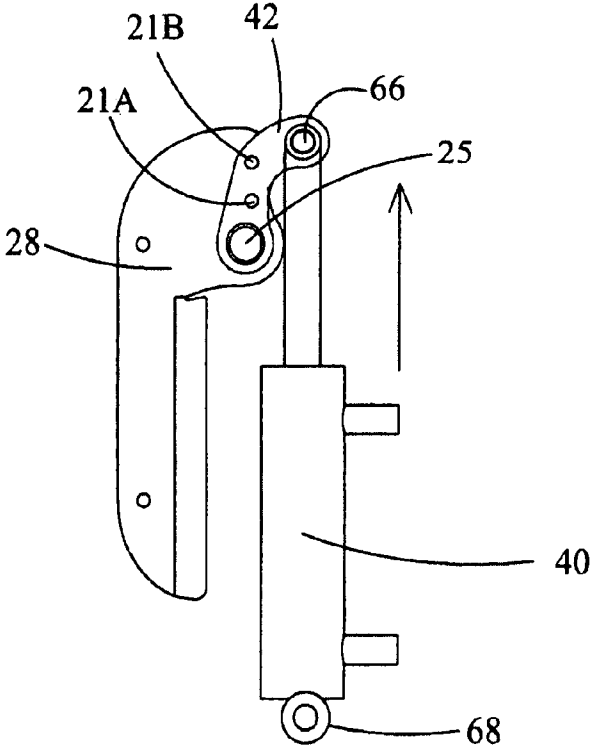
FIG. 5 is a side view of the internal elements of the wood splitter: knife with the expanded cylinder.

FIGS. 5 and 6 show the internal assembly and operation of the portable wood splitter with the main elements such as the knife 28, the lever 42 and the cylinder 40. FIG. 5 shows the first configuration of the elements where the knife 28 is in closed position after a cut has been performed or when the knife is in storage position.

FIG. 6 shows the second configuration of the elements where the knife 28 is in open position before a cut is performed. Between the two configurations, a movement of rotation according to revolution angle 60 of the knife is performed during the cutting process of a piece of wood. The rotating movement is produced by the action of the cylinder 40 which produces a mechanical force to the lever 42 which transfer; the force to the arched extension 48 of the knife 28. In FIGS. 5 and 6, the cylinder head 66 is attached to the lever 42 using a cylinder attachment hole 47 connected to the lever. A cylinder foot 68 is attached to the system by the support pin 32. The knife 28 is attached to the lever 42 using the set of holes 21A, 21B, 45A and 45B. The rotation of the knife 28 is done around the axes passing through the knife pivot hole 25 and the lever pivot hole 43.

Figure 6A:
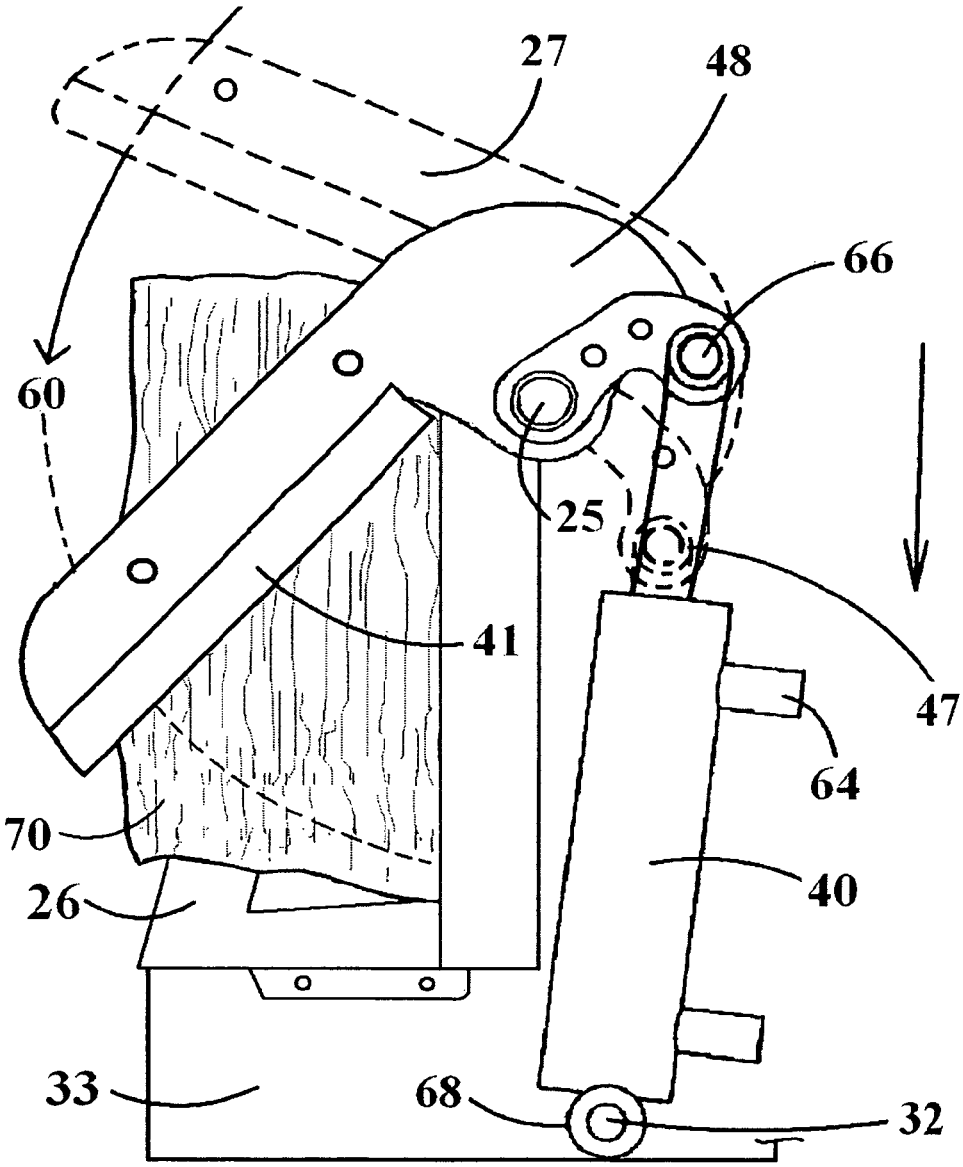
FIG. 6A is a side view of FIG. 6 superimposed onto FIG. 5 with the motion of a cutter blade 27 in motion half way into a wood log.

FIG. 6A shows a wood log 70 in position being cut, with the cutting blade 41 having rotated about the knife pivot hole 25 −210° from a horizontal direction to the right.

SUMMARY OF THE INVENTION

The invention consists of a compact and portable wood splitter which can be easily carried and handled.

It possesses handles 34,35,37 for easy transportation and a dorsal hook 39 that allows the invention to be installed on a wall or a mobile support such as a truck or car trailer. The wood splitter functions with the use of a hydraulic cylinder 40, which actuates the knife so that it carries out a pendulum movement against a piece of wood during the cut process. The piece of wood is placed in an upright position on a platform 26 at the base of an enclosure provided with a rigid front part 24 which sustains a pivot point 25 and the force of the cylinder is transmitted through the lever about the pivot point to the knife which follows a curved trajectory against the piece.

The action of the cylinder is carried out from a control valve within a foot pedal system linked to a hydraulic unit which controls the pressure of the cylinder.

APPLICATIONS

A compact and portable wood splitter, comprises a front platform with a rectangular hole at the base of said wood splitter for allowing the support of a wood log to be cut, a knife located in the head of the wood splitter and used for wood log splitting, a hydraulic cylinder which actuates the knife, a lever linking the knife to the cylinder so that the force applied by the cylinder be transmitted to the knife.

The wood splitter comprises an "L" shaped enclosure which is composed of a material such as sheet iron, aluminium, magnesium, iron, glass, plastic or steel.

The knife comprises an external part and an internal part with regard to the enclosure. The external part of the knife comprises a blade which penetrates the wood piece and the internal part of the knife comprises a curved extension.

The curved extension comprises attachment means for the lever and comprises rotation means of the knife.

The rotation means comprises attachment means of the lever to the cylinder.

The cylinder comprises a cylinder head located at the upper extremity of the cylinder and a cylinder foot located at the lower extremity of the cylinder: the hydraulic cylinder being oriented vertically, almost perpendicular to the platform;

The rotation means of the knife comprises a pivot point and in which a pivot pin is inserted, which is also inserted inside the rotation hole of the lever, the whole assembly allowing the knife to rotate around a rotation axis located at the pivot point.

The attachment means of the knife on the lever comprise at least one attachment point comprising one hole on the knife and one hole on the lever in which a bolt is inserted for attaching the knife to the lever. The attachment means of the lever on the cylinder comprise a pin inserted in the cylinder head and inserted in the attachment hole of the lever.

A centrally pivoted lever 42 linking the knife 28 to the cylinder 40 so that a push applied upwardly onto an end of the lever by the cylinder, be transmitted downwardly an opposite end of the lever and onto the knife, thereby splitting the wood log positioned between the knife and the base. The attachment means of the knife on the lever comprise at least one attachment point comprising one knife hole 25 and one lever hole 43 wherein a bolt is inserted for attaching the knife to the lever.

A pin is inserted in the head 66 of the cylinder 40 and inserted in a hole located on the lever 42.

The blade 27 of the knife follows a circular trajectory realized according to a revolution angle limited by an extension of the cylinder: when the cylinder is contracted, being on its low level, the blade of the knife is on standby for cutting, when the cylinder is released, the blade of the knife is essentially parallel with the rigid front part 24 of the enclosure.

The enclosure comprises a vertical slit 50 on its front face and comprises a safety plate 58, the blade slipping inside the slit and being brought against the safety plate 58 when the cylinder is released. The hydraulic cylinder 40 is activated from a pedal which slackens a fluid for moving a stem of the cylinder.

A method of for splitting firewood log having the following steps:

(a) select a platform 26 located at the base, for holding a piece of wood to be cut in an upright position, comprising a rigid front part 24;

(b) provide a knife to locate in the head and intended to slice the piece of wood; the knife consisting of two parts: a blade 27, and a curved extension 29 of the blade;

(c) provide cylinder means comprising a head 66 and a foot 68 to locate inside the enclosure and to be oriented perpendicularly of the platform;

(d) provide a lever 42 comprising attachment means for the knife and for the cylinder in order to transmit the power provided by the cylinder to the knife and provide pivot means in the lever and in the rigid front part for moving the cylinder in one direction while the knife moves in one opposite direction by seesawing the lever about the pivot.

It is to be clearly understood that the instant description with reference to the annexed drawing is made in an indicative manner and that the preferred embodiments described herein are meant in no way to limit further embodiments realizable within the scope of the invention. The matter which is claimed as being inventive and new is limited only by the appended claims.

LIST OF REFERENCE NUMERALS

20- Enclosure
21A and B- Attachment holes
22- Portable wood splitter
23- Bearing bushing for the knife
24- Rigid front part
25- Knife pivot hole
26- Platform
27- Blade
28- Knife
29- Internal part
30- Pivot pin
31- Lateral shelf
32- Support pin
33- Base plate
34- Lateral handle
35- Top handle
36- Rectangular hole
37- Bottom handle
39- Dorsal hook
40- Cylinder
41- Cutting blade
42- Lever part
43- Lever pivot hole
44- Bearing bushing of the lever
45A and B- Attachment holes
47- Attachment hole of the cylinder
48- Arched extension -continued

| LIST OF REFERENCE NUMERALS |
| --- |
| 50- Slit |
| 52- Lateral plates |
| 58- Support plate |
| 60- Revolution angle |
| 62- Foot pedal |
| 63- Hose for fluid |
| 64- Hydraulic connectors |
| 66- Cylinder head |
| 67- Driving pin |
| 68- Cylinder foot |
| 70- Wood log |

I claim:

1. A portable log splitter device comprising:

an elongated L-shaped enclosure, wherein said L-shaped enclosure comprises a horizontal component base defining a platform for supporting a firewood log in an upright position, said enclosure further comprising a vertical component extending from said horizontal component base, an upper end thereof supporting a pivoting knife comprising a cutting blade adapted to split said log, said pivoting knife revolving about an angle from 0° with respect to a vertical position relating to said vertical component to 150°, between a closed and an open position, said upper end comprising a lever causing a cutting motion of said cutting blade over and into said log when pushed by a piston from said open position to said closed position, said piston being outspread from a cylinder standing in upright position and mounted to said base of said enclosure, and said piston being connected to said lever, wherein said cylinder, said lever and said pivoting knife are substantially enclosed by said vertical component of said enclosure, wherein said lever is kidney shaped, wherein one end of said kidney shaped lever is rotatably connected to said piston of said cylinder and the other end of said kidney shaped lever is fixedly connected to one end of said pivoting knife, to initiate a pivoting motion of said knife, wherein when in said closed position of said log splitter, said piston of said cylinder is in an extended position inside said enclosure, said piston having caused a cutting edge side of said pivoting knife to be in a face down position parallel to said cylinder, passing through a slit cut into a front side of said vertical component of said enclosure and wherein said cutting edge of said knife is entirely inside said enclosure; wherein a non-cutting side edge of said pivoting knife is exposed partially outside of said enclosure, wherein said open position of said log splitter is occurring when said piston is entirely retracted into the cylinder causing said pivoting knife to rotate in a clockwise direction away from said face down position and outside said enclosure so a log can be placed on said platform in an upright position and below said cutting edge of said knife; said piston being then gradually extended causing said knife to pivot downwardly and to split said log by said cutting edge.

2. The splitter device of claim 1 wherein said cylinder comprises a cylinder head located at an upper extremity thereof and a cylinder foot located at a lower extremity thereof; said cylinder being oriented vertically, substantially perpendicular to said platform.

3. The splitter device of claim 1 wherein said enclosure comprises a top handle and bottom handles allowing a user to raise and transport said device from a place to another.

4. The splitter device of claim 3 further comprises a hook mounted on a top end plate of said vertical component of said enclosure.

5. The splitter device of claim 1 wherein said platform comprises a rectangular hole.

6. A method for constructing a firewood log splitter, said method comprising the following steps:

(a) select a platform for supporting a firewood log in upright position; wherein said platform comprises an L-shaped enclosure including a horizontal component base and a vertical component extending from said horizontal component base;

(b) provide on said vertical component of said platform a head comprising a pivoting mechanism;

(c) provide within said pivoting mechanism, a pivoting knife comprising a cutting blade, a pivot point and a lever end, said lever end of said knife being pushed for causing a rotation of said blade over and into said log, said knife revolving about an angle from 0° with respect to a vertical position relating to said vertical component to 150° in an open position, said open position having a cutting edge localized above said firewood log for initiating said splitting;

(d) provide within said a lever a hole attachment means for a driving pin for pivoting said knife through said angle of 150°;

(e) further comprising a cylinder including a piston, said cylinder attached to said platform and said piston attached to said driving pin to transmit the power provided by said cylinder to said knife;

(f) wherein said cylinder, said lever and said pivoting knife are substantially enclosed by said vertical component of said enclosure, (g) further provide a slit cut into a front side of said vertical component of said enclosure.

* * * * *